US007086363B2

(12) United States Patent
Miwa et al.

(10) Patent No.: US 7,086,363 B2
(45) Date of Patent: Aug. 8, 2006

(54) SPARK PLUG AND IGNITION APPARATUS USING SAME

(75) Inventors: Tetsuya Miwa, Nagoya (JP); Tohru Yoshinaga, Okazaki (JP); Keiji Kanao, Aichi-ken (JP); Shinichi Okabe, Okazaki (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 0 days.

(21) Appl. No.: 10/926,003

(22) Filed: Aug. 26, 2004

(65) Prior Publication Data

US 2005/0016485 A1 Jan. 27, 2005

Related U.S. Application Data

(62) Division of application No. 10/073,255, filed on Feb. 13, 2002.

(30) Foreign Application Priority Data

Feb. 13, 2001 (JP) ..... 2001-35932
Jan. 31, 2002 (JP) ..... 2002-23520

(51) Int. Cl.
*F02P 1/00* (2006.01)

(52) U.S. Cl. ..... 123/169 EL; 313/141

(58) Field of Classification Search ..... 123/169 EL, 123/169 EA, 169 R; 313/141, 144
See application file for complete search history.

(56) References Cited

U.S. PATENT DOCUMENTS 4,109,633 A * 8/1978 Mitsudo et al. ..... 123/169 EL
5,461,275 A 10/1995 Oshima
5,514,929 A * 5/1996 Kawamura ..... 313/141
5,517,961 A 5/1996 Ward
5,877,584 A 3/1999 Kato et al.
5,898,257 A 4/1999 Sequerra et al.
6,094,000 A 7/2000 Osamura et al.
6,147,441 A 11/2000 Osamura
6,232,704 B1 5/2001 Herweg et al.
6,265,814 B1 7/2001 Yoshinaga et al.
6,304,022 B1 10/2001 Matsutani
6,328,025 B1 12/2001 Marrs
6,346,766 B1 2/2002 Kanao et al.
6,407,487 B1 6/2002 Sugimoto
6,412,465 B1 7/2002 Lykowski et al.
6,573,641 B1 * 6/2003 Matsutani ..... 313/141
6,653,767 B1 * 11/2003 Morita et al. ..... 313/141
6,707,237 B1 3/2004 Teramura et al.
6,750,598 B1 * 6/2004 Hori ..... 313/141

(Continued)

FOREIGN PATENT DOCUMENTS

JP 52-36237 3/1977

(Continued)

*Primary Examiner*—Mahmoud Gimie
(74) *Attorney, Agent, or Firm*—Nixon & Vanderhye PC

(57) ABSTRACT

A power-saving type of ignition apparatus is provided with a spark plug of which electrodes (30, 40) are regulated in their shapes to lower an amount of energy required for its ignition. To face to a tip (31) of a center electrode (30) extending from a mounting bracket (10), a cylindrical protrusion (41) is built on one surface (43) of an earth electrode (40). The protrusion extends toward the center electrode to form a discharge gap (50) between the protrusion and the tip of the center electrode. Both of the tip of the center electrode and the protrusion of the earth electrode are 2.3 [mm] or less in each diameter (D1, D2), thus an amount of energy required for ignition being limited to 17 [mJ] or less.

26 Claims, 12 Drawing Sheets

U.S. PATENT DOCUMENTS 6,798,125 B1 * 9/2004 Sugiyama et al. ..... 313/141
6,844,662 B1 * 1/2005 Morita et al. ..... 313/141

FOREIGN PATENT DOCUMENTS

JP 05-135846 6/1993
JP 08-298178 11/1996
JP 9-7733 1/1997
JP 9-219274 8/1997
JP 10-41047 2/1998
JP 11-204233 7/1999
JP 2001-307858 11/2001

* cited by examiner

SPARK PLUG AND IGNITION APPARATUS USING SAME

This application is a division of Application No. 10/073,255, filed Feb. 13, 2002, the entire contents of which is hereby incorporated by reference in this application.

BACKGROUND OF THE INVENTION

The present invention relates to a spark plug and an ignition apparatus using the same.

There is a variety types of spark plugs to ignite an engine. FIG. 11 shows one type of conventionally used ordinary spark plug. This spark plug is provided with a mounting bracket 10, a cylindrical center electrode 30 mounted on the mounting bracket 10, and a prismatic earth electrode 40 fixedly coupled with the mounting bracket 10. The center electrode 30 has one end 31 formed into a cylinder and extends from one end 11 of the mounting bracket 10, the one end 31 being insulation-supported within the mounting bracket 10 from an insulating glass member 20 intervening therebetween. The earth electrode 40 has one end secured to the one end 11 of the mounting bracket 10 and the other end extends so that its frontal surface 43 faces the one end 31 of the center electrode 30.

A high voltage generated by an ignition coil of an ignition power supply installed in an ignition apparatus is applied to a spatial gap (discharge gap) formed between the one end 31 of the center electrode 30 and the one surface 32 of the earth electrode 40. This application causes both the electrodes to ignite (i.e., spark discharge), thus firing an air-fuel mixture.

In such a spark plug, it has been known that an amount of input energy necessary for ignition is a sum of combustion energy necessary for firing the air-fuel mixture and cooling energy consumed by the electrodes of a spark plug.

Though a rate of the cooling energy to the combustion energy in the ignition energy has been unknown, to make both the center and earth electrodes compact will reduce the cooling energy, due to improvement in heat drawability of the electrodes. As a result, an amount of energy necessary for the ignition is lowered, saving energy consumed by an ignition apparatus.

However, the relationship between the conformations of the electrodes and a necessary amount of the ignition energy has not been solved yet, and how to decide the ignition energy in designing a spark plug of which electrodes are made compact has long been unknown.

Japanese Patent Laid-open Publication No. 52-362237 discloses another way of improving the ignitability of a spark plug. In the spark plug according to the publication, both of a high-voltage electrode and an earth electrode are shaped into thin types of electrodes each protruding from each support member. The inventors conducted an abrasion test on an actual spark plug produced based on the concept of the protruding electrodes disclosed by the publication. The test results proved that the electrodes wore more badly than previously supposed by the inventors. However, the foregoing publication does not provide any information about how to reduce such poor wear performance.

SUMMARY OF THE INVENTION

Therefore, an object of the present invention is to provide, with due consideration to the drawback of such a conventional spark plug, a spark plug capable of lowering the ignition energy by regulating the conformations of the electrodes thereof, thus saving energy consumed by an ignition apparatus.

A second object of the present invention is to provide a spark plug and an ignition apparatus using the same, which are able to secure a steady ignitability and reduce the wear of the electrodes.

The study conducted by the inventors showed that the conventional spark plug needed, at most, an amount of energy of 17 [mJ] to ignite. Thus, an amount of energy of 17 [mJ] became an index for the inventors' study. Hence, the inventors examined an amount of energy necessary for ignition, as both of a center electrode and a facing part of an earth electrode to the center electrode were reduced in diameters. Reducing the diameters was carried to lower cooling energy occurring at the electrodes. The inventors' analyses resulted in the configurations expressed in the claims appending to this specification.

A first conclusion revealed by the inventors' study is that, when the one end of the center electrode and the protrusion of the earth electrode, which mutually faces with a discharge gap therebetween, are both a diameter-reduced cylindrical shape of which diameter is 2.3 [mm] or less, energy necessary for ignition can be lowered down to amounts of 17 [mJ] or less.

From the first conclusion, there is provided a first configuration of the present invention is an ignition apparatus having a spark plug comprising: a mounting bracket (10) capable of being mounted to an internal combustion engine; a center electrode (30) insulatedly-supported by the mounting bracket, one end (31) of which being a cylindrical form and exposedly extending from one end (11) of the mounting bracket; and an earth electrode (40) having one end coupled with the one end of the mounting bracket and the other end on which one surface (43) is formed to face to the one end of the center electrode, the one surface having a cylindrical protrusion (41) being secured thereon and extending toward the center electrode so as to face the one end of the center electrode, a spacing formed between the one end of the center electrode and the protrusion of the earth electrode serving as a discharge gap (50), the one end of the center electrode and the protrusion of the earth electrode being both 2.3 [mm] or less, and an amount of ignition energy required by the spark plug being less than 17 [mJ].

As shown in the above configuration, the shapes of the electrodes of the spark plug are regulated to lower energy for the ignition, so that the ignition apparatus of which consumed power is saved can be provided.

From the foregoing fist conclusion, there is also provided a second configuration of an ignition apparatus, in which a feature is such that a spacing formed between the one end (31) of the center electrode (30) and the protrusion (41) of the earth electrode (40) serves as a discharge gap (50), the one end of the center electrode and the protrusion of the earth electrode being both 2.3 [mm] or less, and a density of ignition energy required by the spark plug being less than 32 [W].

Therefore, like the first configuration, the ignition apparatus of which consumed power is saved can be provided.

In general, the more compact the electrodes of spark plug, the more reluctant to be affected by the distance of the discharge gap the growth of a flame nucleus in the discharge gap of a spark plug. Therefore, an ignitability should be saturated at narrower distances of the discharge gap. However, the relationship between the conformations of the electrodes and necessary discharge gaps had not been solved, and it was therefore unknown that what distance should be given to the discharge gap. Voltage requested by spark plugs depends on distances of the discharged gap. If an excess gap distance is given, a higher voltage is needed, being undesirable from a viewpoint of power-saving the ignition apparatus.

In consideration of this fact, the inventors' study also included an examination of distances of a discharge gap to give a steady ignitability, by using a spark plug of which one end of a center electrode and a protrusion of an earth electrode are both reduced in diameter down to 2.3 [mm] or less. The result showed a second conclusion that, even when the discharge gap is 0.6 [mm] or less in length, such diameter-reduced electrodes still provide a good and steady ignitability.

From the foregoing third conclusion, there is also provided a third configuration of the present invention. In the spark plug, the third conclusion and tolerances for discharge gaps (approximately 0.1 mm in a gap width) in manufacturing spark plugs are both considered. Based on the considerations, provided is a spacing formed between the one end (31) of the center electrode (30) and the protrusion (41) of the earth electrode (40) serving as a discharge gap (50). Both of the one end of the center electrode and the protrusion of the earth electrode are shaped into cylindrical forms of which diameters are each reduced to 2.3 [mm] or less, and the discharge gap being 0.7 [mm] or less in length.

As a result, the similar advantages to the first configuration can be gained. In addition, even if the discharge gap is narrowed to lengths as small as 0.7 [mm] or less, an ignitability with stability can be obtained. A spark plug of which requested voltage is lower can be provided.

Narrowing the discharge gap down to 0.7 [mm] or less reduces requested voltage, which allows the withstand voltage of the spark plug to be lowered. A more compact spark plug can be available.

Thus, a fourth configuration is provided. That is, in the case of the mounting bracket (10) having an outer circumferential surface therearound on which a threaded part (12) is thread-coupled with the internal combustion engine, a thread diameter of the threaded part is M12 or less. The threaded part can therefore be made compact, still providing a sufficient withstand voltage to the spark plug.

Further, the foregoing reduction of the diameters of the electrodes to 2.3 [mm] or less may be effective in lowering ignition energy. However, there is still a possibility that a sufficient advantage in lowing the ignition energy depends on the length (protruding length) of the protrusion (diameter-reduced part) of the earth electrode.

Practically, an excessively small protruding length may become an obstacle to the growth of a flame nucleus, failing to sufficiently provide the advantages thanks to the diameter-reduced electrodes. In contrast, when the protruding length is too large, the heat drawability may be deteriorated at the earth electrode, thereby lowering the heat resistance of the protrusion of the earth electrode. Thus, the inventors also performed a study for obtaining the relationship between the protruding length of the protrusion and necessary ignition energy, and gained a fourth conclusion reflected in a fifth configuration.

A fifth configuration is directed to a spacing formed between the one end (31) of the center electrode (30) and the protrusion (41) of the earth electrode (40) serving as a discharge gap (50). Both of the one end of the center electrode and the protrusion of the earth electrode are 2.3 [mm] or less, and a protruding length (L) of the protrusion is 0.3 [mm] or more.

Since the protruding length is 0.3 [mm] or more, a flame nucleus is able to grow without fail. The advantages gained in the first configuration are provided, and a spark plug of which fire performance is improved is provided as well.

As a sixth configuration, the protruding length (L) can be 1.5 [mm] or less. This not only prevents the heat drawability from being deteriorated but also secures an enough heat resistance at the earth electrode.

In the spark plug explained above, as a seventh configuration, it is preferred that the one end (31) of the center electrode (30) and the protrusion (41) of the earth electrode (40) are both 1.1 mm or less in diameter. This provides a further reduction in the diameter of each of the electrodes. By this reduction, energy necessary for ignition can be lessened greatly compared to that needed for the conventional spark plug.

An eighth configuration is provided such that an ignition apparatus comprises the spark plug (S1) of the third configuration; and an ignition power supply (60) for applying voltage to the center electrode (30) and the earth electrode (41). Regulating the conformations of the electrodes makes it possible to provide the ignition apparatus of which consumed power is saved.

Further, as a ninth configuration, there is provided an ignition apparatus comprises the ignition plug (S1) of the third embodiment; and n ignition power supply (60) having an ignition coil for applying voltage to the center electrode (30) and the earth electrode (41), the ignition coil being 22 [mm] or less in coil diameter. As a result, additionally to the advantage obtained by the third configuration, the ignition coil can be made more compact.

Moreover, in a tenth configuration providing an ignition apparatus, a spacing is formed between the one end (31) of the center electrode (30) and the protrusion (41) of the earth electrode (40) serving as a discharge gap (50). The one end of the center electrode and the protrusion of the earth electrode are both 2.3 [mm] or less, and the protrusion is made of one selected from a group consisting of a platinum-based alloy and an iridium-based alloy. A positive voltage is applied to the center electrode by the ignition power supply when starting the discharge.

In spark plugs that adopts the direct-current discharge and applies a positive potential to the center electrode or the alternating-current discharge, the earth electrode is easier to wear. However, adopting the tenth configuration in which a platinum-based alloy or an iridium-based alloy is used to make the protrusion at the earth electrode prevents such a drawback. That is, the wear of the protrusion can be suppressed with the ignition apparatus still power-saved.

Based on the similar reason described in the seventh configuration, an eleventh configuration is obtained from the ignition apparatus of the first configuration. Specifically, it is preferred that both of the one end (31) of the center electrode (30) and the protrusion (41) of the earth electrode (40) are 1.1 [mm] or less in diameter.

For lowering the ignition energy, the shapes of both the one end of the center electrode and the protrusion of the earth electrode are not limited to cylindrical forms. Any pillar form, such as a prismatic form or a pillar form with a step(s), may be used. Even in such a pillar shape, as long as both of the one end of the center electrode and the protrusion of the earth electrode maintain a sectional areas of 4.2 [$mm^2$] or less at all points perpendicular to each axial direction, the similar advantages to the cylindrical one of which diameter is reduced down to 2.3 [mm] or less can be provided.

This concept, which is expressed by using the sectional area, is reflected into twelfth to twenty-second configurations, in which the one end of the center electrode and the protrusion of the earth electrode are both a sectional area of 4.2 [$mm^2$] or less at all positions each perpendicularly crossing an axial direction of each of the one end and the protrusion. In terms of the constituents, the twelfth to twenty-second configurations correspond to the first to eleventh embodiments, respectively, and have the same or similar advantages.

Furthermore, a twenty-third configuration of the present invention has a feature that an ignition energy E [mJ] is applied to the spark plug so that an ignition occurs between the center and earth electrodes, a diameter D of the protrusion is 0.4 [mm] or more, but 2.3 [mm] or less, and relationships of $$0.3\ [\mathrm{mm}] \leqq L \leqq 0.016E^2 - 0.56E + 5.2\ [\mathrm{mm}] \text{ in which } 8.5\ [\mathrm{mJ}] \leqq E \leqq 17\ [\mathrm{mJ}]$$

are realized between a length L of the protrusion and the ignition energy E [mJ]. Because 8.5 [mJ]≦E is maintained, a steady ignitability is given, while E≦17 [mJ] is maintained, necessary ignition energy is reduced to an amount smaller than that required by the conventionally used ordinary spark plug. Thus, the ignition energy can be saved.

In addition, 0.3 [mm] ≦L is accomplished, so that the bases of the electrodes will not prevent a flame nucleus from growing, securing an excellent ignitability. The protruding length L is determined so that $L \leqq 0.016E^2 - 0.56E + 5.2$ [mm] is kept, the tip of the earth electrode will be cooled moderately, thereby reducing the wear of the electrodes. Hence, the excellent ignitability is obtained, the ignition energy can be reduced more, and the wear of the electrodes can be lessened because the ignition energy will not deteriorate the cooling performance of the earth electrode.

In a twenty-fourth configuration of the present invention, both of the one end of the center electrode and the protrusion of earth electrode are 4.2 [$mm^2$] or less in sectional area and a density of the ignition energy is 32 [W] or less. Hence the energy required for ignition can be saved.

In a twenty-fifth configuration of the present invention, both of a diameter D1 of the one end of the center electrode and a diameter D2 of the protrusion of earth electrode are 2.3 [mm] or less and a relationship of $$1.5D2^2 + 0.1D2 + 8[\mathrm{mJ}] \leqq E < 0.34D1^2 + 0.2D1 + 16.4[\mathrm{mJ}]$$

between the ignition energy E [mJ] and the diameters D1 and D2 is realized. Hence, an excellent ignitability for a spark plug having the protruding electrodes is secured, while still saving power for ignition.

In a twenty-sixth configuration of the present invention, both of a diameter D1 of the one end of the center electrode and a diameter D2 of the protrusion of the earth electrode are 2.3 [mm] or less and a relationship of $$3D2^2 + 0.2D2 + 16\ [\mathrm{W}] \leqq Q < 0.68D1^2 + 0.4D1 + 32.8\ [\mathrm{W}]$$

between the density of the ignition energy Q [W] and the diameters D1 and D2 is realized. The same advantages as the twenty-fifth configuration can be obtained.

In a twenty-seventh configuration of the present invention, a discharge (50) formed between the one end and the protrusion is 0.7 [mm] or less in distance. Thus, even when the discharge is narrowed to 0.7 [mm] or less, a steady ignitability is secured, while still lowering voltage required by a spark plug. In addition, when the required voltage is lowered, the withstand voltage of the spark plug can also be lowered, thereby making the spark plug more compact.

According to a twenty-eighth configuration of the present invention, a thread diameter of the threaded part may be M12 or less. Thus, in addition to making the threaded part (that is, a mounting bracket) into a smaller size, a sufficient value of withstand voltage of a spark plug can be given.

According to a twenty-ninth configuration of the present invention, the protruding length L of the protrusion on the earth electrode is 1.5 [mm] or less. This makes it possible to avoid heat drawability at the electrode from being deteriorated, thus securing a higher heat resistance of the protrusion, thus improving wear resistance.

In a thirtieth configuration of the present invention, the protruding length L is 0.8 [mm] or less, moderately suppressing a deterioration in the heat drawability, thus improving wear resistance.

In a thirty-first configuration of the present invention, both of the one end (31) of the center electrode (30) and the protrusion (41) of the earth electrode (40) are 1 [$mm^2$] or less in a sectional area. This enables a further reduction of the diameter, energy necessary for ignition can be lowered to an amount smaller than the conventional by a considerable amount of energy.

In a thirty-second configuration of the present invention, because an ignition power supply (60) has an ignition coil for applying voltage to the center electrode (30) and the earth electrode (41) and the ignition coil is 22 [mm] or less in coil diameter, voltage required by the ignition coil can be lowered. Though the ignition coil is smaller in diameter, its required inner withstand voltage can be reduced, making its production easier.

In a thirty-third configuration of the present invention, positive electric charges are applied to the center electrode by the ignition power supply when staring ignition. Thus, the discharge can be made at the same required voltage as that requiring a negative potential to be applied to the center electrode under the direct-current discharge. As a result, the wear at the center electrode can be suppressed.

In a thirty-fourth configuration of the present invention, both of the one end (31) of the center electrode (30) and the protrusion (41) of the earth electrode (40) are 1 [$mm^2$] or less in a sectional area. This enables a further reduction of the diameter, energy necessary for ignition can be lowered to an amount smaller than the conventional by a considerable amount of energy.

In a thirty-fifth configuration of the present invention, the protrusion (41) of the earth electrode (40) is made of an alloy of which main composition is Pt and to which at least one component selected from the group consisting of Ir, Ni, Rh, W, Pd, Ru and Os is added. This makes it possible to reduce the wear at the protrusion.

In a thirty-sixth configuration of the present invention, the protrusion (41) of the earth electrode (40) is made of an alloy of which main composition is Pt and to which at least one component selected from the group consisting of Ir of 0 to 50 wt %, Ni of 0 to 40 wt %, Rh of 0 to 50 wt %, W of 0 to 30 wt %, Pd of 0 to 40 wt %, Ru of 0 to 30 wt %, and Os of 0 to 20 wt % is added. The wear that will occur at the protrusion can be weakened.

In a thirty-seventh configuration of the present invention, the protrusion (41) of the earth electrode (40) is made of an alloy of which main composition is Ir and to which at least one component selected from the group consisting of Rh, Pt, Ni, W, Pd, Ru and Os is added. The wear that will occur at the protrusion can also be weakened.

In a thirty-eighth configuration of the present invention, the protrusion (41) of the earth electrode (40) is made of an alloy of which main composition is Ir and to which at least one component selected from the group consisting of Rh of 0 to 50 wt %, Pt of 0 to 50 wt %, Ni of 0 to 40 wt %, W of 0 to 30 wt %, Pd of 0 to 40 wt %, Ru of 0 to 30 wt %, and Os of 0 to 20 wt % is added. The wear at the protrusion can be lessened.

The references enclosed in parentheses in the above configurations correspond to constituents detailed in the following embodiments, but it is not meant that those references do not limit the scope of the present invention.

PREFERRED EMBODIMENTS OF THE INVENTION

Referring to the accompanying drawings, preferred embodiments of the present invention will now be described.

Figure 1:
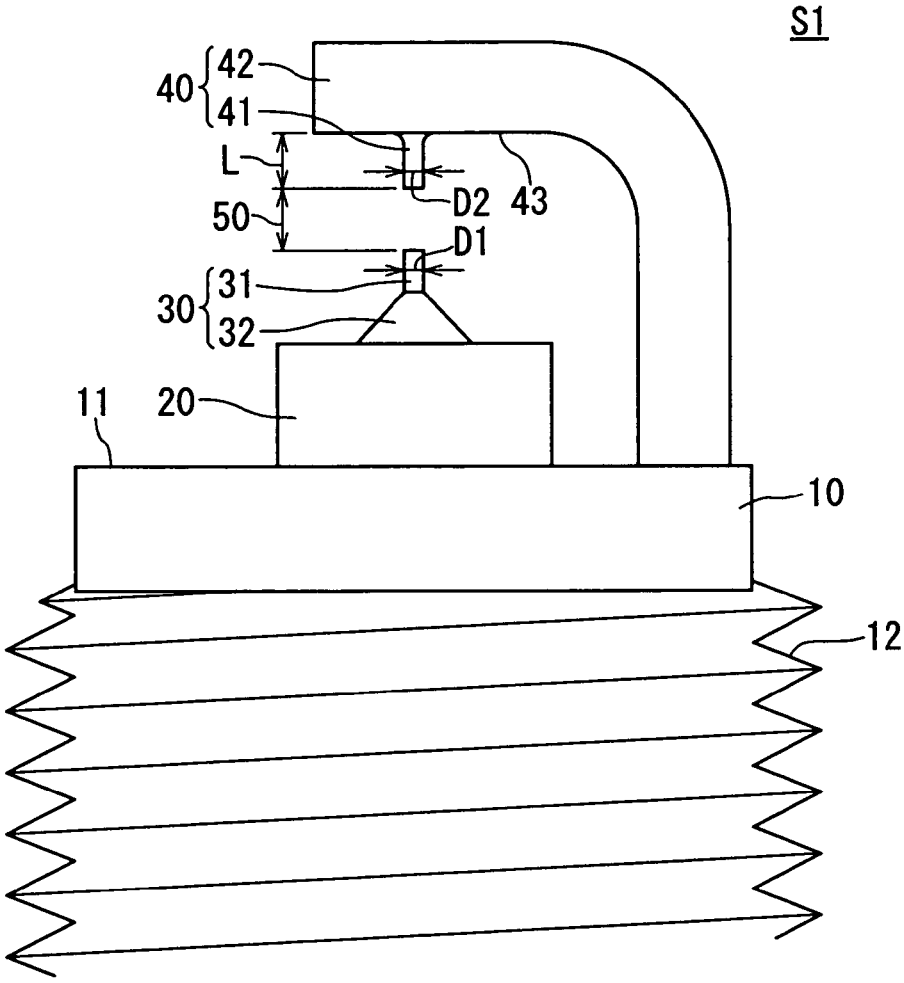
FIG. 1 is a partial schematic view showing an essential part of a spark plug according to one embodiment of the present invention.

Referring to FIGS. 1 to 8 and 11 to 13, one embodiment of the present invention will now be described. FIG. 1 partially shows the configuration of a spark plug S1, but only an essential part thereof, according to the first embodiment. The spark plug S1 has a mounting bracket 10, which can be attached to an automobile engine (not shown) employed as an internal combustion engine. The mounting bracket 10 is made of carbon steel and manufactured into a cylindrical form through various types of working, such as cold forging and cutting working.

FIG. 1 shows one end of the mounting bracket 10. On the outer circumferential surface of the mounting bracket 10 is formed a mounting threaded part 12 for thread-fastening the spark plug to a mounting hole of the engine. The thread diameter of the mounting threaded part 12 can be formed as being a size of M12 or less.

Inside the mounting bracket 10, a center electrode 30 is incorporated with an insulator (insulating glass member) made of an electrically insulating material such as alumina. This allows the center electrode 30 to be supported by the mounting bracket 10 in an electrically insulated manner. In addition, the center electrode 30 is formed into a rod and attached to the mounting bracket 10 so that it extends along the axial direction of the spark plug S1. Further, one end 31 of the center electrode 30 protrudes from one end 11 of the mounting bracket 10 so as to be exposed in the air.

The one end 31 of the center electrode 30 is a tip made of a platinum-based alloy or an iridium-based alloy weld-fastened on a base 32 made of nickel-based alloy. In this embodiment, the base 32 is made to taper little by little toward the one end 31 (tip) of the center electrode 30. On the other hand, the tip 31 is shaped into a cylinder extending by a predetermined length from the base 32 along the axial direction of the spark plug S1.

To the one end 11 of the mounting bracket 10 is also secured an earth electrode 40 having a base 42 and a cylindrical protrusion 41 extending from the base 42. The base 42, of which one end is secured to the mounting bracket 10, extends from the one end 11 thereof, and then bends almost perpendicularly so that one frontal surface 43 of the other end thereof faces to the tip 31 of the center electrode 30. The protrusion 41 is fixedly built on the one surface 43 of base 42 in such a manner that it approaches and faces to the tip 31 of the center electrode 30.

More practically, in this embodiment, the base 42 of the earth electrode 40 is shaped into a prismatic form. A part of the earth electrode 40 ranging from one end to a predetermined position in the course thereof extends along the axial direction of the center electrode 30 (i.e., the axial direction of the plug). The remaining part is bent approximately perpendicularly so that its tip is located over the tip 31 of the center electrode 30. Both of the tip 31 of the center electrode 30 and the protrusion 41 of the earth electrode 40 are made to be coaxial with each other.

The base 42 of the earth electrode 40 is made of a material such as a nickel-based alloy, and its protrusion 41 is composed of a tip made of a platinum-based alloy or an iridium-based alloy fastened on the base 42 by means of welding. An opposing spacing is left, as a discharge gap 50, between the frontal surface of the tip 31 of the center electrode 30 and the frontal surface of the protrusion 41 of the earth electrode 40, both of the tip 31 and the protrusion 41 being cylindrical.

Figure 2:
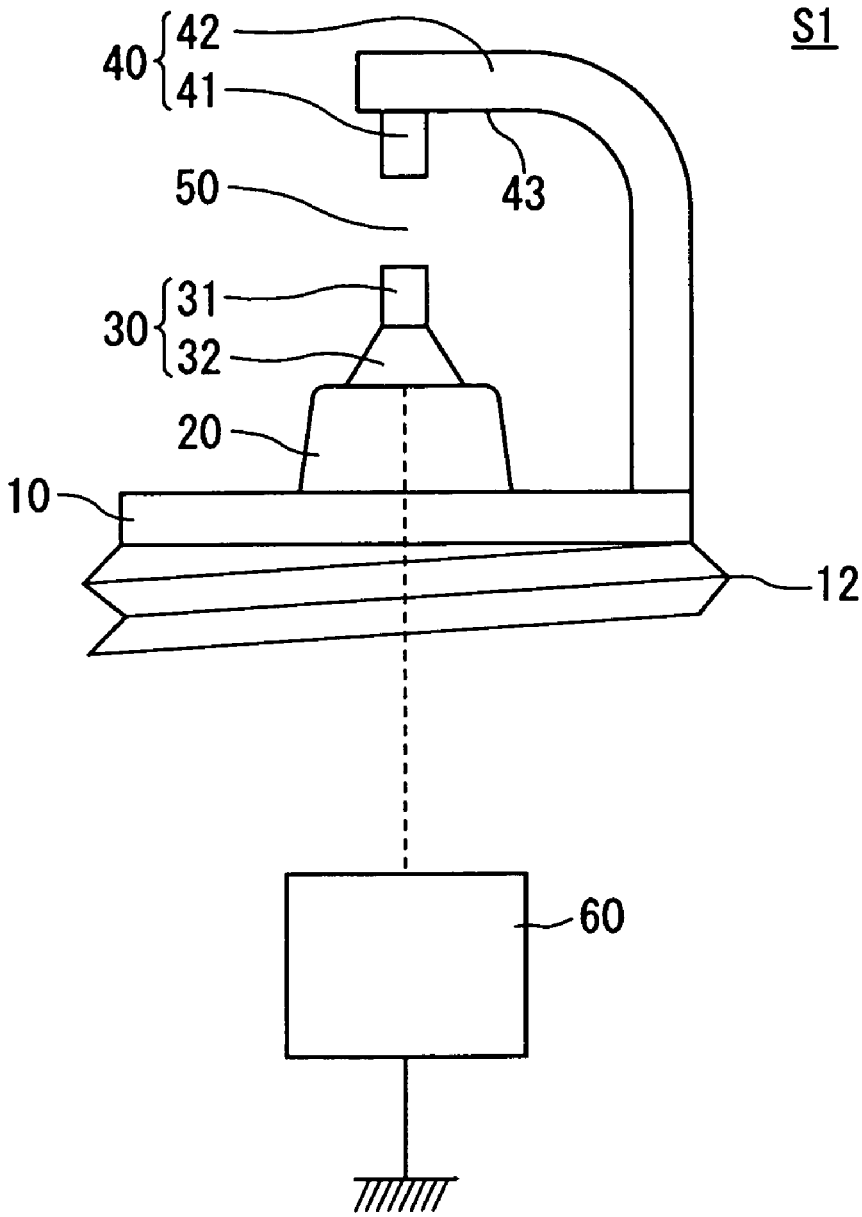
FIG. 2 pictorially shows an ignition apparatus that uses the spark plug shown in FIG. 1.

An ignition apparatus according to the present embodiment is shown FIG. 2. The ignition apparatus has the foregoing ignition plug S1 and an ignition power supply 60 for applying voltage to the center and earth electrodes 30 and 40 of the spark plug S1. The ignition power supply 60 includes a stick type of ignition coil (not shown) to generate a high voltage and is configured to apply the negative potential of the voltage to the center electrode 30.

In the present embodiment, the dimensions of the constituents are characteristic of regulated amounts as follows. The diameter D1 of the tip 31 of the center electrode 30 and the diameter D2 of the protrusion 41 of the earth electrode 40 are both 2.3 [mm] or less (preferably, 1.1 [mm] or less). The discharge gap 50 is preferably 0.7 [mm] or less. The protruding length L of the protrusion 41 of the earth electrode 40 is 0.3 [mm] or more. Additionally, the foregoing ignition coil is 22 [mm] or less in diameter.

These regulated dimensions are based on various experiments conducted by the inventors. The reasons for those dimensions will now be exemplified with reference to FIGS. 3 to 8, although not limited to the exemplified ones.

Figure 3:
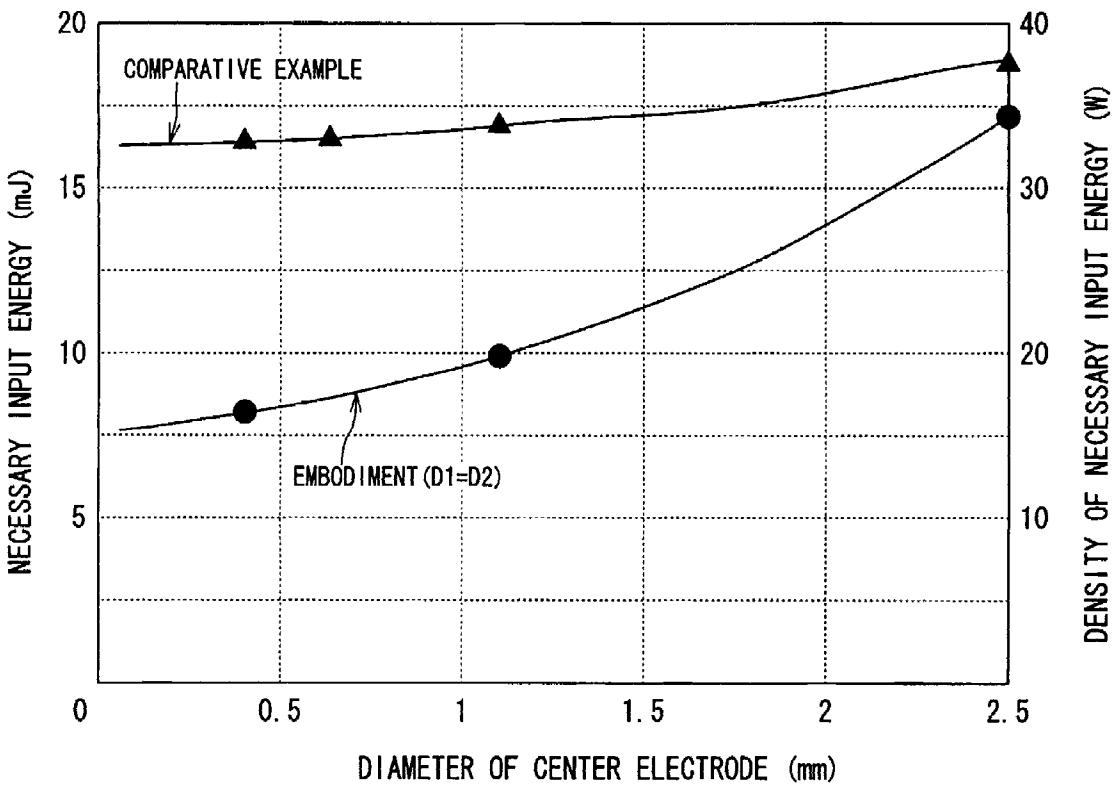
FIG. 3 is a graph showing the relationship between the diameter of a center electrode and input energy necessary for ignition.
Figure 11:
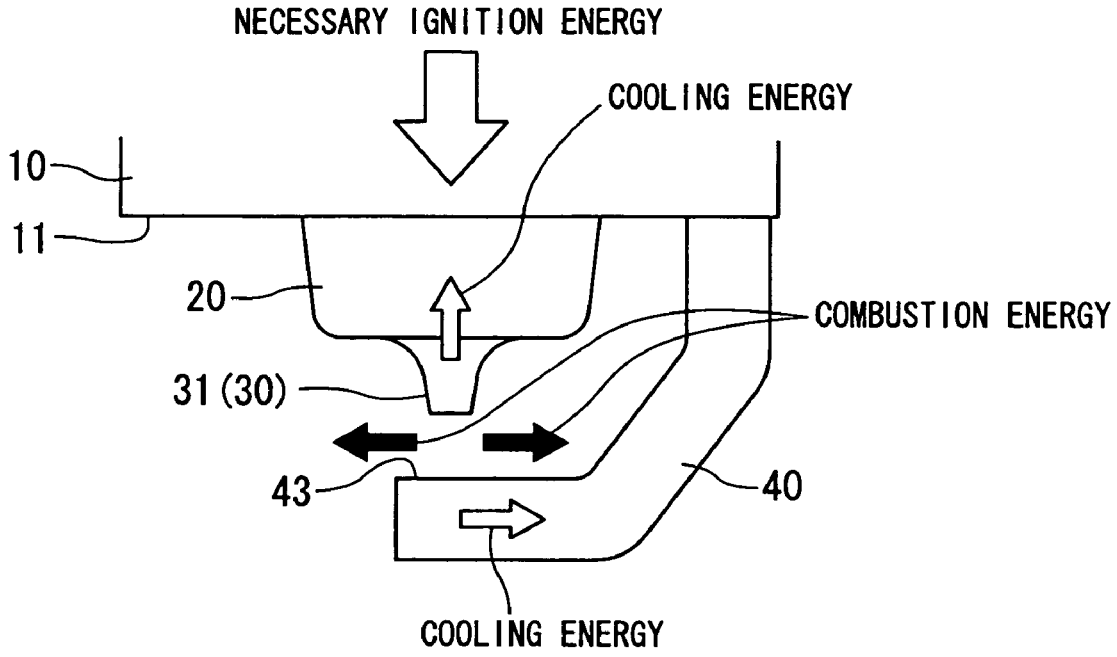
FIG. 11 shows an essential part of a conventional ordinal spark plug.

FIG. 3 shows analyzed results of the relationship between the diameter of the center electrode and an amount of input energy necessary for ignition (necessary input energy). In FIG. 3, data shown by "comparative example" were obtained from the conventional ordinary spark plug produced as shown in FIG. 11 (i.e., a discharge part of the earth electrode 40 is 1.6 [mm] in width and 2.8 [mm] in thickness). Data shown by "embodiment" in FIG. 3 were obtained when both of the tip 31 of the center electrode 30 and the protrusion 41 of the earth electrode 40 (its protruding length L is 0.5 [mm]) are equal in diameter to each other (D1=D2). For the data of the comparative example and the embodiment, several spark plug samples were produced, in which the tip 31 of the center electrode 30 for each sample was changed in its diameter D1.

Each sample was attached to an engine, and a density of ignition energy necessarily inputted and an amount of necessary input energy were acquired sample by sample, under the operational conditions that a pressure in the engine when igniting is 0.5 [Mpa], A/F (a mixture ratio of air to fuel) is 22, a density of oxygen of air injected is 18 [%], and a flow velocity of air-fuel mixture when igniting is 5 [m/s]. These operational conditions provide the highest amount of necessary inputted energy in practical use.

The density of ignition energy necessarily inputted (necessary input energy density) was calculated as a multiplication of current and voltage of a spark plug under discharge. The necessary inputted energy is then obtained by multiplying the necessary inputted energy density by a discharge time of 0.5 [ms] necessary under the foregoing operational conditions.

In FIG. 3, the lateral axis shows the diameter D1 [mm] of the tip 31 of the center electrode 30. In contrast, the left longitudinal axis shows the necessary input energy [mJ] and the right longitudinal axis shows the necessary inputted energy density [W].

From the curves in FIG. 3, it can be understood that in the case of the conventional spark plug according to the comparative example (filled triangles), a maximum amount of 17 [mJ] is required as the necessary input energy and a maximum amount of 32 [W] is required as the necessary input energy density, even when the diameter D1 of the tip 31 of the center electrode 30 is made as thin as possible.

By contrast, the spark plug according to the embodiment (filled circles), in which both the tip 31 of the center electrode 30 and the protrusion 41 of the earth electrode 40 are 2.3 [mm] or less in diameter, is able to lower the cooling energy consumed by the electrodes. That is, the necessary input energy can be reduced down to amounts of less than 17 [mJ], and the necessary input energy density can be lowered down to amounts-of less than 32 [W].

The curve of the comparative example provides an amount E1 of necessary input energy defined by $$E1=0.34D1^2+0.2D1+16.4 \text{ [mJ]}$$

and a density Q1 of necessary input energy defined by $$Q1=0.68D1^2+0.4D1+32.8 \text{ [W]},$$

in which D1 is the diameter of the tip of the center electrode employed by the comparative example.

The curve of the embodiment provides an amount E2 of necessary input energy defined by $$E2=1.5D2^2+0.1D2+8 \text{ [mJ]}$$ and a density Q2 of necessary input energy defined by $$Q2=3D2^2+0.2D2+16 \text{ [W]},$$

in which D2 is the diameter of the tip of the center electrode (=the protrusion of the earth electrode) employed by the embodiment.

The necessary input energy (and its density) in relation to the diameter of the tip of the center electrode (=the diameter of the protrusion of the earth electrode) can be set an amount selected from the range between the two definitions stated above. Such setting enables the spark plug to have a satisfactory ignitability with an amount of ignition energy smaller than that required for the spark plug according to the comparative example.

As a result, regulating the diameters D1 and D2 of the discharge parts 31 and 41 of both the electrodes 30 and 40 to amounts of 2.3 [mm] or less enables ignition energy (ignition energy density) to be lessened compared to 17 [mJ] (32 [W]) required for the conventional spark plug. This saves energy consumed by the ignition apparatus.

Moreover, as clearly understood from FIG. 3, regulating both the diameters D1 and D2 to amounts of 1.1 [mm] or less and making the discharge parts more thinner in diameter will lead to a greater reduction in the necessary input energy for ignition (necessary input energy density for ignition) compared to that of the conventional spark plug.

Figure 4:
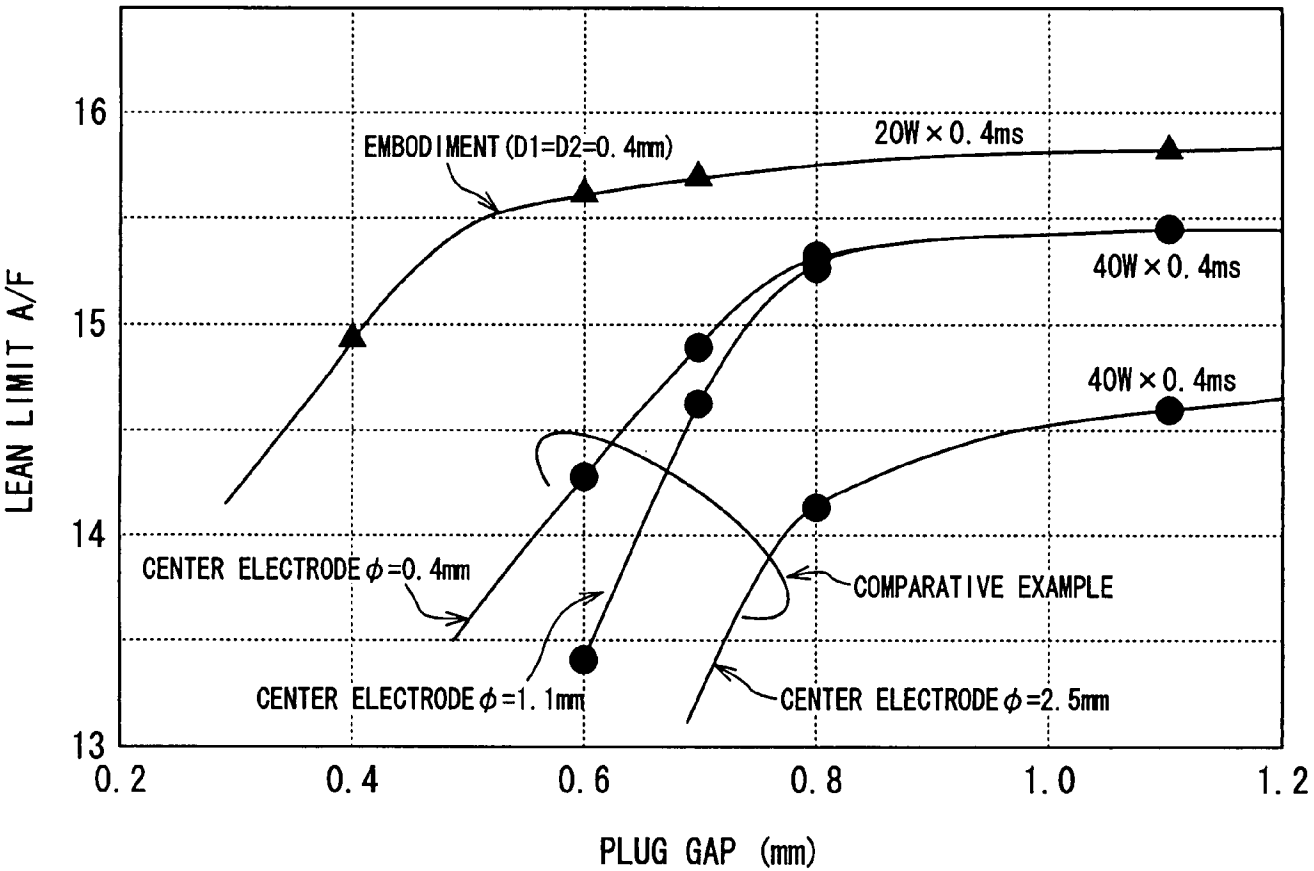
FIG. 4 is a graph showing the relationship between a plug gap and a lean limit.

FIG. 4 exhibits analyzed results of the relationship between various lengths of the discharge gap (plug gap) and ignitability. A lean limit is used as a factor indicative of the ignitability. The lean limit is defined as an A/F with the least fuel, which still satisfies a combustion fluctuation rate PmiCOV ("dispersion of mean effective pressure"/"mean value") at which combustion is established without fail.

Curves rebelled as the "Comparative example" in FIG. 4 were derived from the conventional ordinary spark plug having the structure shown in FIG. 11, of which earth electrode 40 has, as describe above, a discharge part shaped in 1.6 [mm] in width and 2.8 [mm] in thickness. Various spark plug samples were manufactured with center electrode 30 changed into 0.4 [mm], 1.1 [mm], and 2.5 [mm] in the diameter D1 of the one end 31, respectively. In contrast, a curve rebelled as the "embodiment" in FIG. 4 was obtained from the spark plug according to the configuration shown in FIG. 1, in which both the tip 31 of the center electrode 30 and the protrusion 41 of the earth electrode 40 (its protruding length is 0.5 [mm]) are 0.4 [mm] in the diameter (D1=D2). Spark plug samples with different discharge gaps were produced.

Each sample was attached to a four-cylinder, 1800 [cc] engine and, under an idling state (800 [rpm] and a water temperature of 50 [° C.]) that imposes a hard combustion condition (firing condition) on the engine, the lean limit to satisfy a combustion fluctuation rate PmiCOV of 15 [%] was obtained.

In FIG. 4, the lateral axis shows the discharge gap (plug gap: [mm]), while the longitudinal axis shows the lean limit (A/F). Among the curves rebelled as the comparative example indicating conventional spark plugs (represented by the filled circles), even when the diameter of the protruding part of the center electrode 30 is made smaller down to 1.1 [mm] or less, there is no difference in improvement of the ignitability in the range of discharge gaps of 0.8 [mm] or more.

Additionally, in the conventional spark plugs, the ignitability is lowered when the discharge gap is made smaller than 0.8 [mm], despite degrees at which the one end 31 of the center electrode is made thinner in diameter. The reason is considered such that a quench action (an obstacle to the growth of a flame nucleus) resultant from the earth electrode 40 has a large influence on the ignitability.

In contrast, in the case of the curve rebelled as the embodiment (refer to the filled triangles), the ignitability can be improved largely compared to the conventional ones in cases where the discharge gap is 0.6 [mm] or more. The necessary inputted energy is also decreased from "40 [W]× 0.4 [ms]," which is an amount corresponding to the conventional, to "20 [W]×0.4 [ms]."

This results from the fact that both the tip 31 of the center electrode 30 and the protrusion 41 of the earth electrode 40 are made thinner in diameter, thus the cooling energy consumed by the electrodes being lowered substantially and a combustible duration being shortened owing to a large reduction in the quench action at the earth electrode.

The curve rebelled as the embodiment in FIG. 4 is based on the configurations that both of the tip 31 of the center electrode 30 and the protrusion 41 of the earth electrode 40 have the same diameter 0.4 [mm] (D1=D2). However, as long as each of the diameters D1 and D2 is kept to amounts of 2.3 [mm]or less, the improved character which is almost the same as that shown in FIG. 4 will be obtained, through some irregularities may occur.

When considering tolerances (approximately a gap width of 0.1 [mm]) in manufacturing an ordinary discharge gap, together with the results shown by FIG. 4, narrowing the discharge gap to amounts of 0.7 [mm] or less (but, preferably 0.6 [mm] or more) is still effective, and enables a steady ignitability. Thus a spark plug with a reduced required voltage can be provided.

As stated above, the required voltage is lowered when the discharge gap is 0.7 [mm] or less, and the withstand voltage needed for a spark plug can be lowered as well. It is therefore possible to make the spark plug compact. In particular, if the threaded part 12 for thread-coupling with an engine is formed on the outer circumferential surface of the mounting bracket, as explained before, the thread part 12 can be made compact in its thread diameter.

Figure 5:
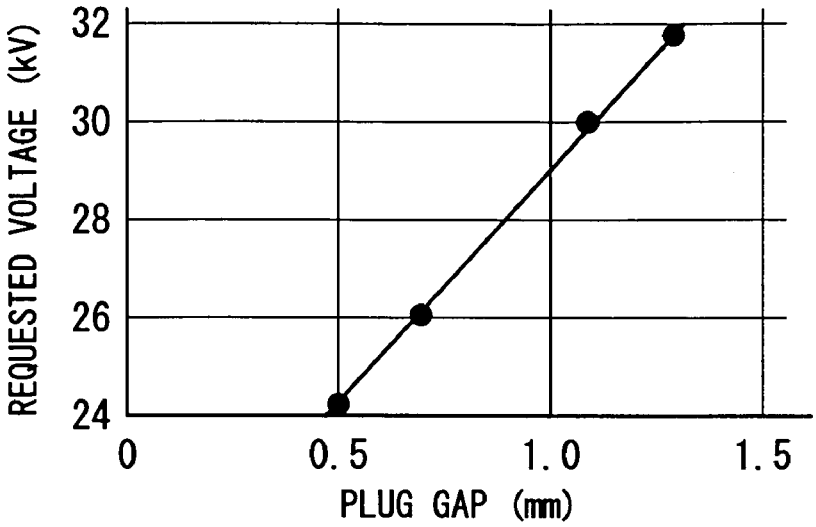
FIG. 5 is a graph representing the relationship between the plug gap and required voltage for ignition.
Figure 6:
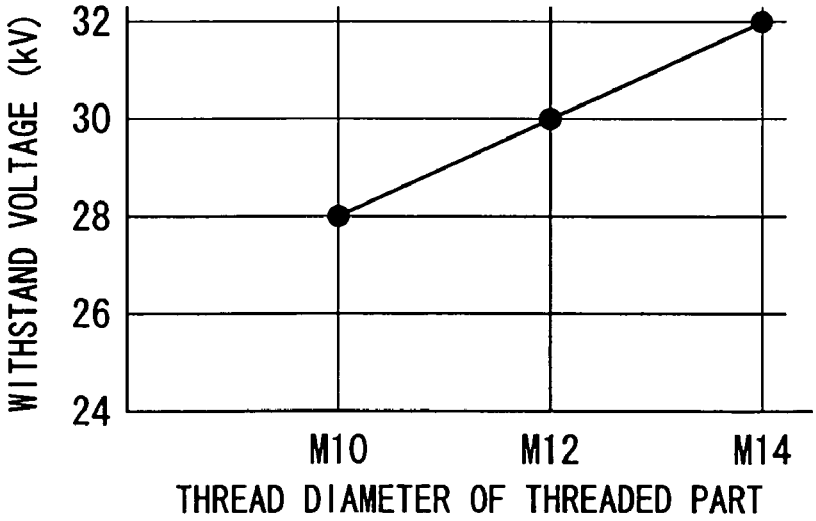
FIG. 6 is a graph representing the relationship between the diameter of a screw in a threaded part of a mounting bracket of the spark plug and withstand voltage thereof.

FIG. 5 represents the relationship between the discharge gap (plug gap: [mm]) and the required voltage [kV], which was also studied by the inventors. FIG. 6 represents the relationship between the thread diameter of the threaded part 12 and the withstand voltage [kV] of the spark plug.

Conventionally used ordinary spark plugs were about 32 [kV] in requested voltage (i.e., withstand voltage) and M14 in the thread diameter. In the present embodiment, however, the discharge gap 50 can be narrowed (to 0.7 [mm] or less), so that the requested voltage can also be as low as 26 [kV]. Thus if reducing the thread diameter of the threaded part 12 to dimensions of M1 or less, the withstand voltage of spark plugs can fully be secured.

Figure 7:
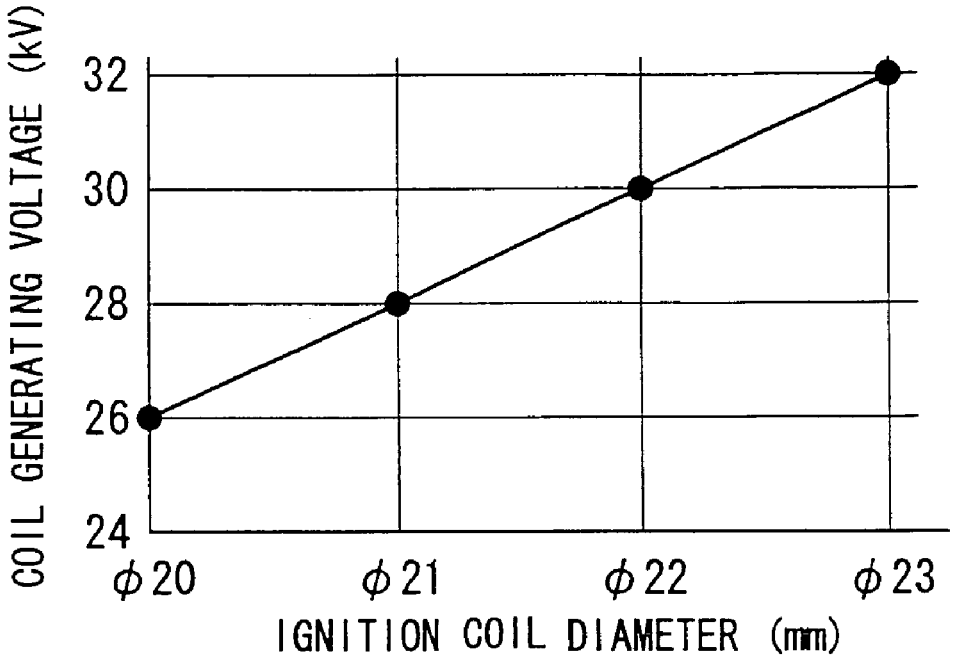
FIG. 7 is a graph representing the relationship between the diameter of the spark plug and voltage generated by a coil.

Furthermore, to reduce the discharge gap 50 to lengths of 0.7 [mm] or less allows the request voltage, that is, coil generating voltage to be reduced as well. This is able to make it compact the diameter of the ignition coil arranged in the ignition power supply 50 of the ignition apparatus. The relationship between the diameter [mm] of an ignition coil and amounts [kV] of coil generating voltage is shown in FIG. 7, of which analysis was carried out by the inventors. This graph shows that the diameter of the ignition coil can be reduced down to 22 [mm] or less (but preferably 20 [mm] or more), making it more compact.

Figure 8:
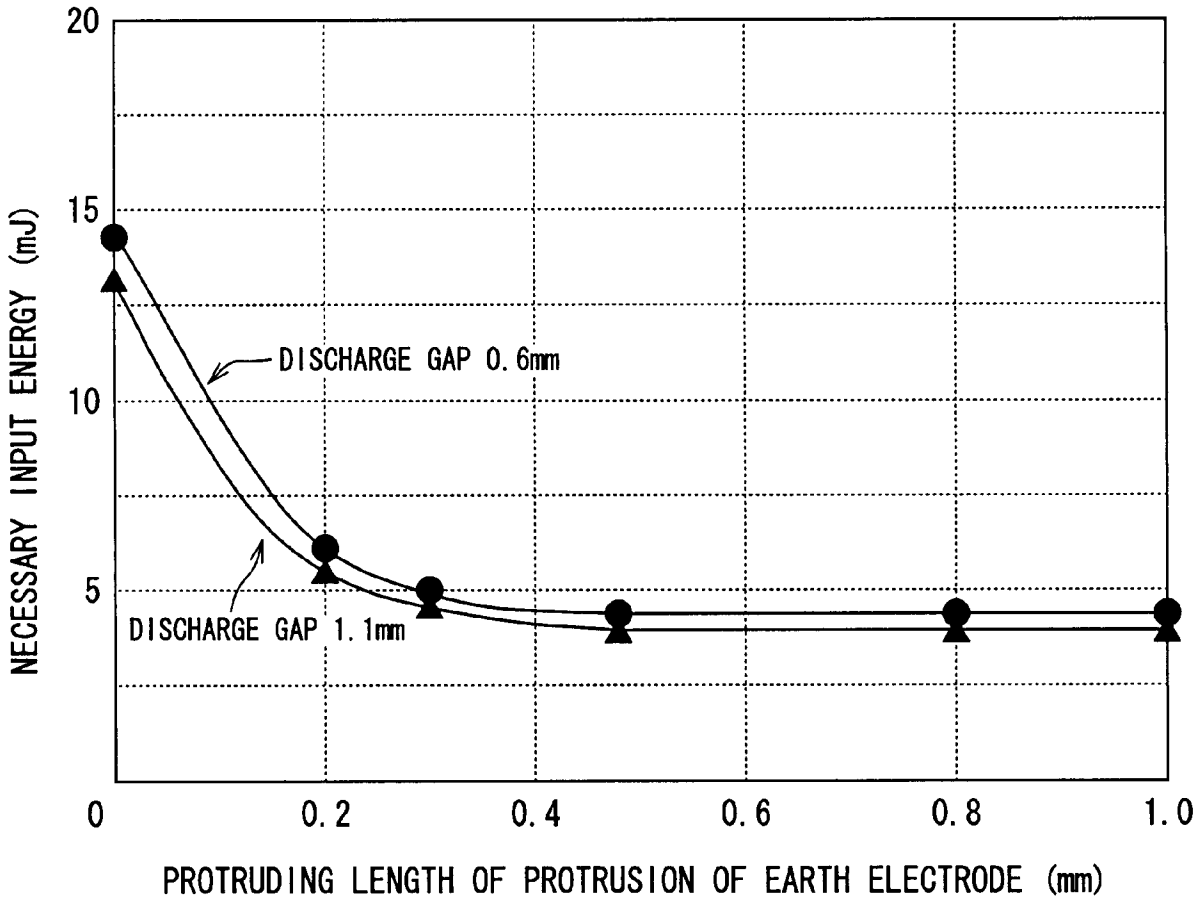
FIG. 8 is a graph representing the relationship between the length of a protrusion mounted on the earth electrode and the input energy necessary for ignition.

FIG. 8 also exhibits analyzed results conducted by the inventors, which is directed to the relationship between the protruding length L of the protrusion 41 of the earth electrode 40 and the necessary input energy. In conducting the analysis, both the tip 31 of the center electrode 30 and the protrusion 41 of the earth electrode 40 are 0.4 [mm] in diameter (D1=D2). Each of samples of spark plugs of which discharge gaps 50 are 0.6 [mm] and 1.1 [mm], respectively, was manufactured with different earth electrode protruding lengths.

Each sample was attached to an engine and subjected to the following operational conditions to obtain amounts of necessary input energy. The conditions were determined such that a pressure in the engine when staring the ignition was 0.5 [Mpa], A/F was 22, a density of oxygen of injected air was 18 [%], and a flow velocity of air-fuel mixture when starting the ignition is 1 [m/s].

The lateral axis of FIG. 8 represents the earth electrode protruding length L [mm], whilst the longitudinal axes thereof represents the necessary input energy [mJ]. A spark plug of which length L is zero corresponds to the conventional one. The graphs show that, in cases where the earth electrode protruding length L is 0.3 [mm] or more, the inputted ignition energy can be reduced largely, compared to the conventional, with no relation to the dimensions of the discharge gap 50.

This advantage is derived from the fact that the base 42 of the earth electrode 40 can be far away from a flame nucleus so as not to influence its growth. When the earth electrode protruding length L is 0.3 [mm] or more, the cooling energy can be lowered, thus providing a steady ignition energy lowering effect thanks to the foregoing thinning of the electrode discharge parts. Therefore, the ignitability can be improved.

If the protruding length L of the protrusion 41 of the earth electrode 40 is too long, it may be difficult to give a high heat resistance to the protrusion 41, due to a deterioration in the heat drawability thereof. Hence, it is desirable that the length L of the protrusion 41 remain within amounts of 1.5 [mm] or less.

As can be understood from the above, the basis for regulating the characteristic dimensions of the spark plug and their advantages resulting from the regulated dimensions have been descried.

Figure 12:
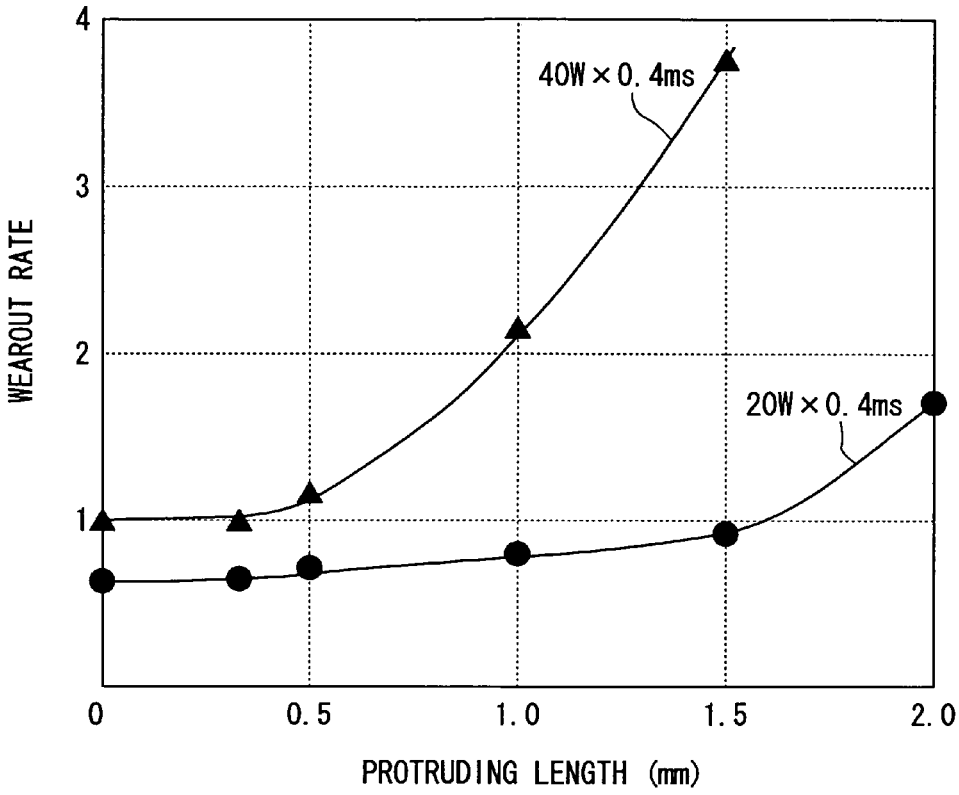
FIG. 12 shows the relationship between the protruding length of the protrusion (or protruding part) of the earth electrode.
Figure 13:
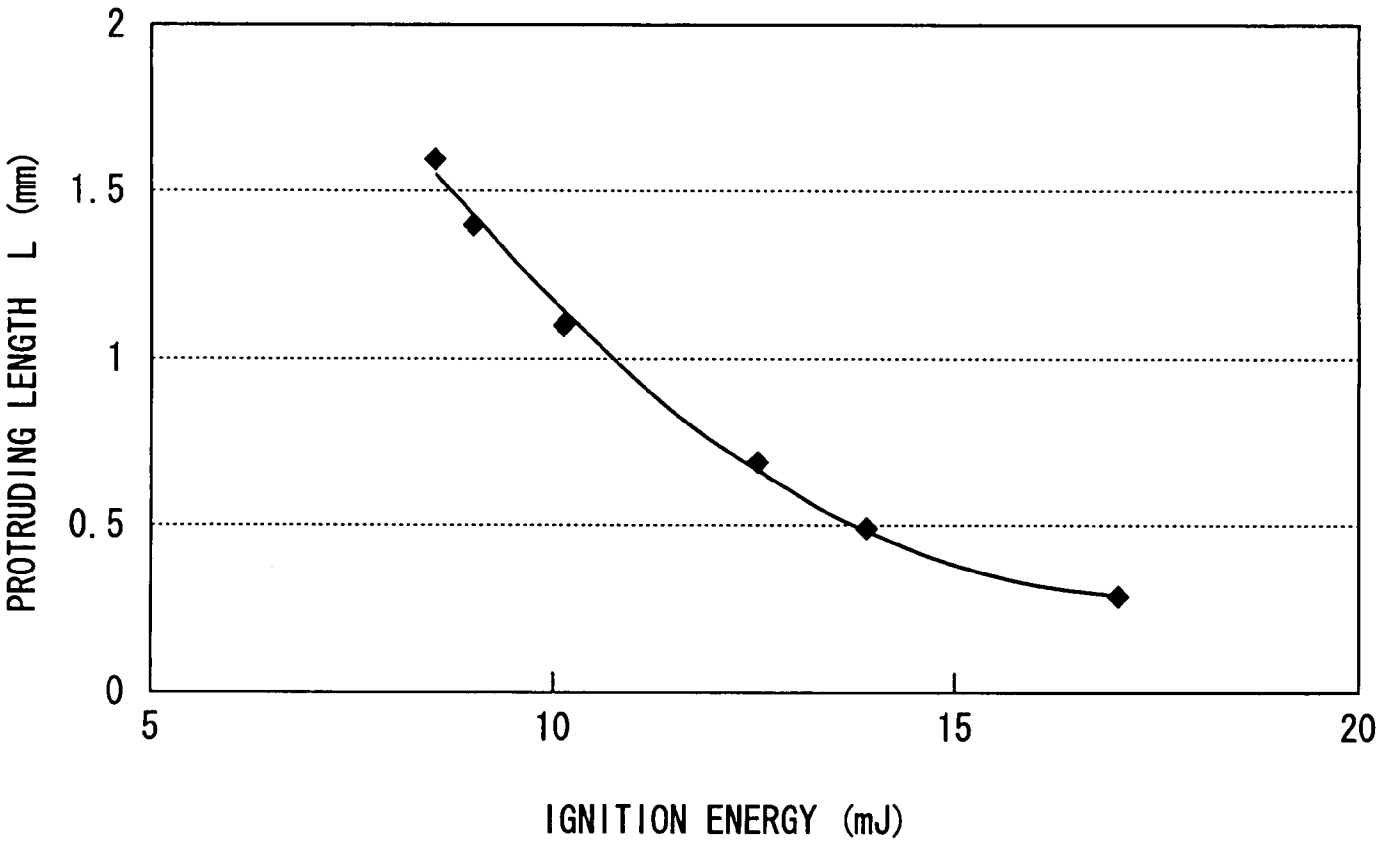
FIG. 13 shows an equi-wearout rate line decided with certain coordinates of the ignition energy and the protruding length.

FIGS. 12 and 13 show analysis results conducted by the inventors in relation to the wear of the spark plug of which electrodes have protruding parts formed according to the present embodiment.

In FIG. 12, the lateral axis shows the protruding length of the protrusion on the earth electrode, while the longitudinal axis shows a wearout rate. The wearout rate shows amounts worn off by the spark plug according to the present embodiment, and is indicated by making comparison with a conventional spark plug of which center electrode has a protruded part alone, as shown in FIG. 11.

Specifically, each protrusion (or protrude part) of both the conventional spark plug and the plug and according to the present embodiment was 0.4 [mm] in diameter. The protruded tip part of center electrode of the conventional spark plug and both the protruded tip of the center electrode and the protrusion of the earth electrode of the spark plug according to the present embodiment were made of the same material, that is, iridium including of 10 wt % rhodium. The amounts of wear were measured as gap lengths. The test used a 2000 [cc] engine with a supercharger operated at an rotation speed of 5600 [rpm] for 200 hours, with an air fuel ratio (A/F) of 12.5 and a fully opened throttle. In the test, amounts of wear were measured for each of the conventional spark plug and the spark plug according to the present embodiment. Each wearout rate was figured out by dividing an amount worn off by the spark plug of the present embodiment by that of the conventional spark plug. In FIG. 12, the smaller the wearout rate, the less the wear of the spark plug according to the present embodiment (that is, the longer the life of the spark plug).

In FIG. 12, a first line connecting the filled triangles indicates wearout rates obtained when ignition energy of which density is 40 [W] was applied for 0.4 [ms], while a second line connecting the filled circles wearout rates obtained when ignition energy of which density is 20 [W] was applied for 0.4 [ms]. The line connecting the filled circles shows a comparatively gentle increasing slope with an increase in the protruding length. In contrast, the line connecting the filled triangles shows a comparatively sharp increase at a protruding length of approximately 0.5 [mm] with an increase in the protruding length. As the protruding length becomes longer, the electrode is reluctant to be cooled and the temperature at the tip of the protrusion (or protruding part) increases, so that the wear thereat becomes larger. In the case of the line connecting the filled circles, obtained when the applied ignition energy is smaller, the curve of the wearout ratio is entirely gentle. In contrast, in the case of the line connecting the filled triangles, the longer the protruding length, the larger deterioration of the heat drawability. As a result, as the protruding length becomes longer, the temperature at the tip of the protrusion (or protruding part) increases, resulting in larger amounts of wear.

Accordingly, the line connecting the filled circles reveals that, as long as an ignition energy density of approximately 20 [W] is applied for some 0.4 [ms] and the protruding length remains within 1.6 [mm] or less, a wearout ratio equivalent to the conventional can be secured. That is, FIG. 12 suggests that the wearout ratio equivalent to the conventional can be obtained by selecting a condition (ignition energy to be applied) from the range defined by both the conditions (applied ignition energy) assigned to the two curves.

On the other hand, FIG. 13 shows an equi-wearout rate line connecting coordinates of ignition energy and protruding lengths, both of which satisfy a ware-out rate of 1. In FIG. 13, the lateral axis represents the ignition energy E and the longitudinal axis represents the protruding length L.

The equi-wearout rate line is diffident by an expression:

$$L=0.016E^2-0.56E+5.2$$

Thus, one characteristic feature of the present invention can be obtained by a region surrounded by the above expression, a lateral straight line at L=0.3 [mm], and a longitudinal straight line at E=8.5 [mJ].

In the case of FIG. 13, only the equi-wearout rate line for a wearout rate of 1 is present. An upper right side in FIG. 13 shows greater wearout rates, whilst a lower left side (nearer to the origin) shows smaller wearout rates. Thus, provided that the protruding length is the same, the smaller the ignition energy, the smaller the wearout rate. By contrast, if the ignition energy is the same, the protruding length becomes smaller, as the wearout rate reduces.

In addition, since the spark plug S1 that has the various advantages, the foregoing embodiment is also able to provide the ignition power supply 60 that has the identical various advantages to those ones. Thus, the ignition power supply that is able to save power energy can be provided.

Further, the spark pug S1 has the tip 31 of the center electrode 31 and the protrusion 41 of the earth electrode 40 are both reduced in diameter down to 2.3 [mm] and made of a noble metal such as a platinum-based alloy or an iridium-based alloy. The ignition apparatus 60, which is electrically coupled to such spark plug S1 as shown in FIG. 2, is configured to apply voltage such that the center electrode 30 is subjected to its negative (−) potential.

Concerning this application, an alternative configuration can be provided. That is, the voltage created by the ignition apparatus can be applied such that the center electrode 30 receives it positive (+) potential. The alternating-current voltage can also be applied in the same way. In such cases, it is preferred that the protrusion 41 of the earth electrode 40 be made of a platinum-based alloy or an iridium-based alloy.

In cases where the center electrode 30 is subjected to receive the positive (+) potential of the voltage, the discharge will occur such that electrons impinge onto the tip 31 of the center electrode 30 and positive ions impinge onto the protrusion 41 of the earth electrode 40. Because, the positive ion is higher in mass than the electron, the protrusion 41, onto which the positive ions impinge, is apt to wear more than the tip 31 of the center electrode 30. However, the above modification is able to provide the protrusion 41 made of a platinum-based alloy or an iridium-based alloy that shows higher heat resistance and higher wear resistance, so that the wear can be suppressed moderately.

In addition, it is preferable that the protrusion 41 of the earth electrode 40 is made of an alloy of which main composition is Pt and to which at least one component selected from the group consisting of 0 to 50 wt % of Ir, 0 to 40 wt % of Ni, 0 to 50 wt % of Rh, 0 to 30 wt % of W, 0 to 40 wt % of Pd, 0 to 30 wt % of Ru, and 0 to 20 wt % of Os is added. As an alternative example, the protrusion 41 of the earth electrode 40 may be made of an alloy of which main composition is Ir and to which at least one component selected from the group consisting of 0 to 50 wt % of Rh, 0 to 50 wt % of Pt, 0 to 40 wt % of Ni, 0 to 30 wt % of W, 0 to 40 wt % of Pd, 0 to 30 wt % of Ru, and 0 to 20 wt % of Os is added.

[Other Embodiments]

Figure 9A:
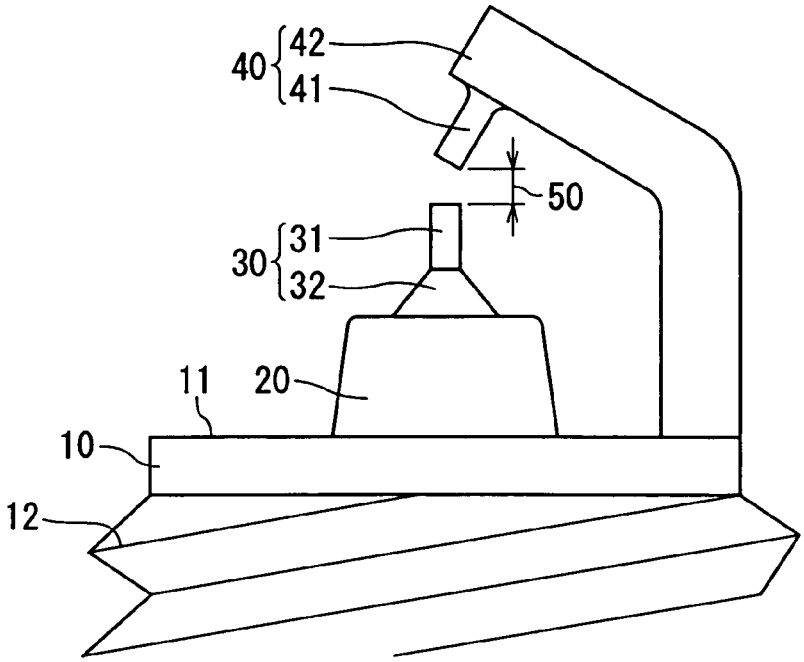
FIGS. 9A and 9B are graphs each representing a modification of arrangement in which both the center and earth electrodes are opposed to each other.
Figure 9B:
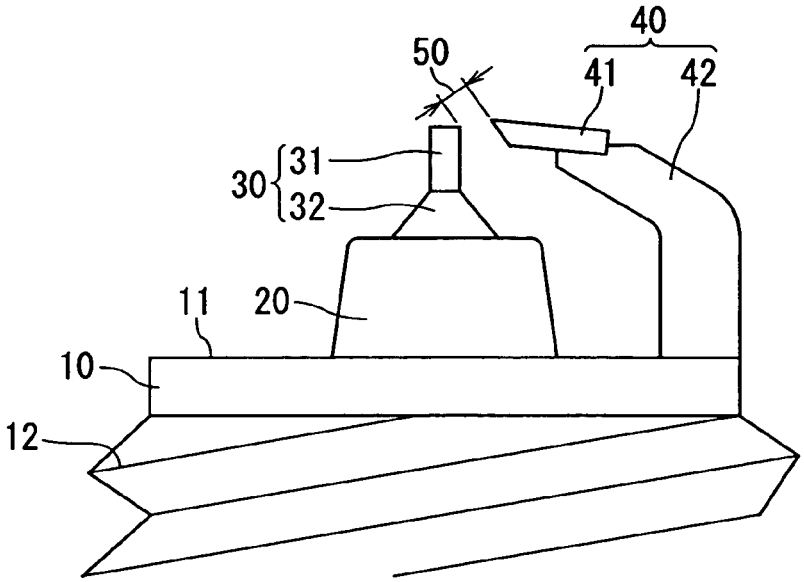

Various embodiments with respect to the positional relationship between the center electrode 30 and the earth electrode 40 are shown in FIGS. 9A and 9B. Both the center electrode 30 and the earth electrode 40 can be arranged in such a manner that the axial directions of the tip 31 and the protrusion 41 cross to each other at a certain angle, as shown in FIG. 9A or 9B. Especially, as depicted in FIG. 9B, the frontal surface of the protrusion 40 of the earth electrode faces to a side of the tip 31 of the center electrode 30.

Although there is a possibility that the wear will decrease to some extent, the tip 31 and the protrusion 41 of both the electrodes 30 and 40 may be made of materials other than the foregoing ones. Such materials include the same material as that composing their bases 32 and 42, such as a Ni-based alloy. When such materials are used, the tip 31 and the protrusion 41 can therefore be formed by cutting each base or welding a thin-diameter chip.

Furthermore, both of the tip 31 of the center electrode 30 and the protrusion 41 of the earth electrode 40 maybe produced into various shapes, not limited to a cylindrical shape described above. Either the tip 31 or the protrusion 41 or both of them may be produced into a prismatic shape, pillar shape with a step(s), or pillar shape with an arbitrary cross section. Various shapes of both the tip 31 and the protrusion 41 are exemplified in FIGS. 10A to 10G.

Figure 10A:
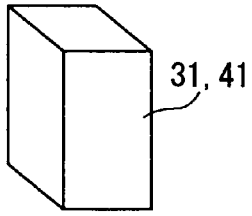
FIGS. 10A to 10G show modifications of a variety of shapes of both the one end of the center electrode and the protrusion of the earth electrode.
Figure 10B:
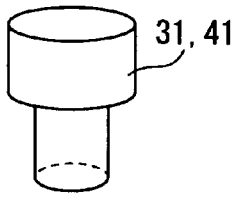
Figure 10C:
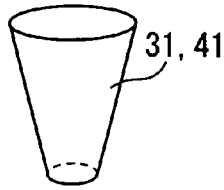
Figure 10D:
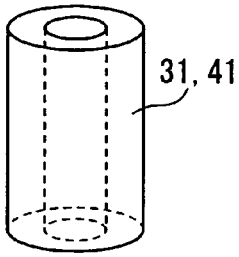
Figure 10E:
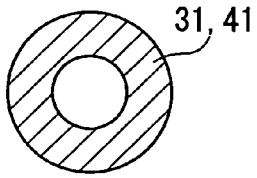
Figure 10F:
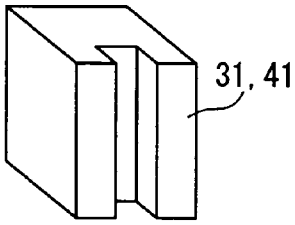
Figure 10G:
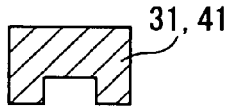

FIGS. 10A and 10B exemplify a prismatic shape and a pillar with a step, respectively. FIG. 10C shows one example of a pillar shape of which cross-section perpendicular to its axis is tapered. FIG. 10D shows a hollow cylinder, while FIG. 10E shows its cross section perpendicular to its axis. Further, FIG. 10F shows a prismatic pillar with a groove on its one side, while FIG. 10G shows its cross section perpendicular to its axis.

Each pillar depicted in FIGS. 10A to 10G is limited to an amount of 4.2 [$mm^2$] or less in the sectional area perpendicular to each axis. That is, every section (i.e., other than the hollow portion or the groove potion shown in FIG. 10E or 10G) perpendicular to the axis of each pillar is 4.2 [$mm^2$] or less in its sectional area.

Thus, all the pillars depicted in FIGS. 10A to 10G have the identical advantages to a cylindrical pillar of which diameter is reduced to 2.3 mm or less. When the above sectional area is reduced down to 1 [$mm^2$] or less, all the foregoing pillars in FIGS. 10A to 10G have the identical advantages to a cylindrical pillar of which diameter is reduced to 1.1 mm or less.

Although the description above contains many specificities, these should not be construed as limiting the scope of the invention but as merely providing illustrations of some of the presently preferred embodiments of the present invention. Thus the scope of the present invention should be determined by the appended claims and their equivalents.

The invention claimed is:

1. A spark plug comprising:

a mounting bracket to be mounted to an internal combustion engine;

a center electrode having both a base extending so as to be exposed from an end of the mounting bracket in an axial direction of the plug and a tip end part secured to a distal end of the base in a line in the axial direction, the base being insulatedly-supported by the mounting bracket and formed to taper toward the tip end part and the tip end part having, a cylindrical form; and an earth electrode coupled with the one end of the mounting bracket and is formed to have a cylindrical protrusion extending toward the center electrode so as to face the tip end part of the center electrode in the axial direction, a spacing serving as a discharge gap being formed between the tip end part of the center electrode and the protrusion of the earth electrode, both of the tip end part of the center electrode and the protrusion of the earth electrode being 2.3 mm or less in diameter, respectively, and the discharge gap being 0.7 mm or less in length.

2. The spark plug of claim 1, wherein the mounting bracket has an outer circumferential surface therearound on which a threaded part is thread-coupled with the internal combustion engine, a thread diameter of the threaded part being M12 or less.

3. The spark plug of claim 1, wherein both of the tip end part of the center electrode and the protrusion of the earth electrode are 1.1 mm or less in diameter.

4. The spark plug of claim 1, wherein the tip end part of the center electrode and the protrusion of the earth electrode have substantially the same diameter.

5. The spark plug of claim 1, wherein the respective diameters of both the tip end part of the center electrode and the protrusion of the earth electrode are determined so as to keep an amount of ignition energy to be supplied to the spark plug lower than 17 mJ.

6. The spark plug of claim 1, wherein a density of ignition energy to be supplied to the spark plug is less than 32 W.

7. The spark plug of claim 1, wherein the protrusion of the earth electrode has a base portion and a cylindrical portion which are integrally formed, the base portion being formed to be taper toward the cylindrical portion.

8. A spark plug comprising:

a mounting bracket to be mounted to an internal combustion engine;

a center electrode having both a base extending so as to be exposed from an end of the mounting bracket in an axial direction of the plug and tip end part secured to a distal end of the base in a line in the axial direction, the base being insulatedly-supported by the mounting bracket and formed to taper toward the tip end part and the tip end part having a cylindrical form; and an earth electrode coupled with the one end of the mounting bracket and is formed to have a cylindrical protrusion extending toward the center electrode so as to face the tip end part of the center electrode in the axial direction, a spacing serving as a discharge gab being formed between the tip end part of the center electrode and the protrusion of the earth electrode, both of the tip end part of the center electrode and the protrusion of the earth electrode being 2.3 mm or less in diameter, respectively, and a protruding length (L) of the protrusion being 0.3 mm or more.

9. The spark plug of claim 8, wherein the protruding length (L) is 1.5 mm or less.

10. The spark plug of claim 8, wherein the tip end part of the center electrode and the protrusion of the earth electrode have substantially the same diameter.

11. The spark plug of claim 8, wherein the respective diameters of both the tip end part of the center electrode and the protrusion of the earth electrode are determined so as to keep an amount of ignition energy to be supplied to the spark plug lower than 17 mJ.

12. The spark plug of claim 8, wherein a density of ignition energy to be supplied to the spark plug is less than 32 W.

13. The spark plug of claim 8, wherein the protrusion of the earth electrode has a base portion and a cylindrical portion which are integrally formed, the base portion being formed to be tapered toward the cylindrical portion.

14. A spark plug comprising:

a mounting bracket to be mounted to an internal combustion engine;

a center electrode having both a base extending so as to be exposed from an end of the mounting bracket in an axial direction of the plug and tip end part secured to a distal end of the base in a line in the axial direction, the base being insulatedly-supported by the mounting bracket and formed to taper toward the tip end part and the tip end part, being a pillar like form; and an earth electrode coupled with the one end of the mounting bracket and have a pillar-like protrusion extending toward the center electrode so as to face the tip end part of the center electrode in an axial direction, a spacing serving as a discharge gap being formed between the tip end part of the center electrode and the protrusion of the earth electrode, both of the tip end part of the center electrode and the protrusion of the earth electrode having a sectional area of 4.2 $mm^2$ or less at all positions thereof each perpendicularly crossing the axial direction, the discharge gap being 0.7 mm or less in length, and both the tip end part of the center electrode and the protrusion of the earth electrode being 2.3 mm or less in diameter, respectively.

15. The spark plug of claim 14, wherein the mounting bracket has an outer circumferential surface therearound on which a threaded part to be thread-coupled with the internal combustion engine is formed, a thread diameter of the threaded part being M12 or less.

16. The spark plug of claim 14, wherein both of the tip end part of the center electrode and the protrusion of the earth electrode are a sectional area of 1 $mm^2$ or less at all positions each perpendicularly crossing an axial direction of each of the one end and the protrusion.

17. The spark plug of claim 14, wherein the tip end part of the center electrode and the protrusion of the earth electrode have substantially the same diameter.

18. The spark plug of claim 14, wherein the respective diameters of both the tip end part of the center electrode and the protrusion of the earth electrode are determined so as to keep an amount of ignition energy to be supplied to the spark plug lower than 17 mJ.

19. The spark plug of claim 14, wherein a density of ignition energy to be supplied to the spark plug is less than 32 W.

20. The spark plug of claim 14, wherein the protrusion of the earth electrode has a base portion and a cylindrical portion which are integrally formed, the base portion being formed to be tapered toward the cylindrical portion.

21. A spark plug comprising:

a mounting bracket to be mounted to an internal combustion engine;

a center electrode having both a base extending so as to be exposed from an end of the mounting bracket in an axial direction of the plug and tip end part secured to a distal end of the base in a line in the axial direction, the base being insulatedly-supported by the mounting bracket and formed to taper toward the tip end part and the tip end part having a cylindrical form; and an earth electrode coupled with the one end of the mounting bracket is formed to have a pillar-like protrusion extending toward the center electrode so as to face the tip end part of the center electrode in an axial direction, a spacing serving as a discharge gap being formed between the tip end part of the center electrode and the protrusion of the earth electrode, both of the tip end part of the center electrode and the protrusion of the earth electrode having a sectional area of 4.2 $mm^2$ or less at all positions thereof each perpendicularly crossing the axial direction a protruding length (L) of the protrusion being 0.3 mm or more, and both the tip end part of the center electrode and the protrusion of the earth electrode being 2.3 mm or less in diameter, respectively.

22. The spark plug of claim 21, wherein the protruding length (L) is 1.5 mm or less.

23. The spark plug of claim 21, wherein the tip end part of the center electrode and the protrusion of the earth electrode have substantially the same diameter.

24. The spark plug of claim 21, wherein the respective diameters of both the tip end part of the center electrode and the protrusion of the earth electrode are determined so as to keep an amount of ignition energy to be supplied to the spark plug lower than 17 mJ.

25. The spark plug of claim 21, wherein a density of ignition energy to be supplied to the spark plug is less than 32 W.

26. The spark plug of claim 21, wherein the protrusion of the earth electrode has a base portion and a cylindrical portion which are integrally formed, the base portion being formed to be tapered toward the cylindrical portion.

* * * * *